US011098981B2

(12) United States Patent
Renfroe

(10) Patent No.: US 11,098,981 B2
(45) Date of Patent: Aug. 24, 2021

(54) EXTENDED RAIL SYSTEM AND MOUNT FOR A WEAPON SYSTEM

(71) Applicant: Adam Richard Renfroe, Victoria, MN (US)

(72) Inventor: Adam Richard Renfroe, Victoria, MN (US)

(73) Assignee: Adam Richard Renfroe, Victoria, MN (US)

( * ) Notice: Subject to any disclaimer, the term of this patent is extended or adjusted under 35 U.S.C. 154(b) by 0 days.

(21) Appl. No.: 16/560,581

(22) Filed: Sep. 4, 2019

(65) Prior Publication Data

US 2021/0063115 A1 Mar. 4, 2021

(51) Int. Cl.
*F41G 11/00* (2006.01)
*F41C 23/16* (2006.01)

(52) U.S. Cl.
CPC ..... *F41G 11/003* (2013.01); *F41G 11/004* (2013.01); *F41C 23/16* (2013.01)

(58) Field of Classification Search
CPC ..... F41C 23/16; F41C 23/18; F41G 11/003; F41G 11/004
USPC ..... 42/71.01
See application file for complete search history.

(56) References Cited

U.S. PATENT DOCUMENTS 5,590,484 A * 1/1997 Mooney ..... F41G 1/16 42/111
6,598,331 B1 * 7/2003 Thibodeaux ..... F41G 1/41 42/111
8,769,854 B1 * 7/2014 Battaglia ..... F41A 3/66 42/75.03
9,091,505 B1 * 7/2015 Battaglia ..... F41A 3/66
D748,754 S * 2/2016 Chastain ..... D22/108
D871,536 S * 12/2019 Lessard ..... D22/108
2009/0288324 A1 * 11/2009 Peterson ..... F41A 11/02 42/75.03
2011/0100203 A1 * 5/2011 Genes ..... F41H 5/12 89/9
2011/0131858 A1 * 6/2011 Darian ..... F41G 11/003 42/90
2014/0150318 A1 * 6/2014 Engesser ..... F41A 35/00 42/75.02
2014/0224114 A1 * 8/2014 Faxon ..... F41A 3/66 89/193
2016/0178309 A1 * 6/2016 Drake ..... F41A 35/06 42/14
2016/0209166 A1 * 7/2016 Larson, Jr. ..... F41G 1/033
2017/0184367 A1 * 6/2017 Odle ..... F41A 21/325
2017/0299291 A1 * 10/2017 Spector ..... F41A 13/12
2017/0307314 A1 * 10/2017 Serbu ..... F41A 19/54
2017/0343315 A1 * 11/2017 Beaty ..... F41C 23/16
2018/0003465 A1 * 1/2018 Sessions ..... F41G 11/003
2018/0066905 A1 * 3/2018 Battaglia ..... F41A 11/02
(Continued)

OTHER PUBLICATIONS

Cadex Defense, 870 Top Rail, Aug. 23, 2015, (Year: 2015).*
(Continued)

*Primary Examiner* — Joshua E Freeman
(74) *Attorney, Agent, or Firm* — Wesley W. Malherek; Kelly, Holt & Christenson PLLC

(57) ABSTRACT

An extended rail system for a weapon system includes a forward mount that couples to a first point on the weapon system forward of a barrel shroud and a rail that couples to a second point on the weapon system and the forward mount.

10 Claims, 5 Drawing Sheets

(56) References Cited

U.S. PATENT DOCUMENTS

| | | | | |
|---|---|---|---|---|
| 2018/0142975 | A1* | 5/2018 | Hoon | F41A 11/02 |
| 2019/0113297 | A1* | 4/2019 | Turlakov | F41G 11/003 |
| 2019/0301827 | A1* | 10/2019 | Chebanova | F41A 21/487 |

OTHER PUBLICATIONS

Cadex Defense; 870 Tactical accessories; https://www.youtube.com/watch?v=x336ScWwUAE&feature=emb_logo; Mar. 7, 2014 (Year: 2014).*

* cited by examiner

EXTENDED RAIL SYSTEM AND MOUNT FOR A WEAPON SYSTEM

SUMMARY

An extended rail system for a weapon system includes a forward mount that couples to a first point on the weapon system forward of a barrel shroud and a rail that couples to a second point on the weapon system and the forward mount.

DETAILED DESCRIPTION

Modern weapon systems often employ a rail system, such as a weaver rail or a picatinny rail, that allows the operator to mount optics (e.g. scopes, sights, etc.) or accessories (e.g., bipods, lasers, etc.) to the weapon. Many tactical weapons have rails machined or attached to the body, handguard, or elsewhere on the weapon. Long-range or hunting rifles employ fewer rail systems specifically for a single optic or sights. One such weapon system includes the Serbu BFG-50, which has a very short rail system that limits which types of optics can be mounted on the system. For example, only a single scope can be mounted on the rail system (with narrow scope mounts) and no backup iron sights may be used. Additionally, the Serbu BFG-50 optic mounting system is disposed at the rear end of the barrel on the barrel shroud, which places a large scope near the user's face. This may not be an issue with a smaller caliber rifle but can be a danger to the user's safety with large recoil from a large caliber bullet such as the .50 BMG. An example extended rail system is provided below that alleviates these problems.

Figure 1:
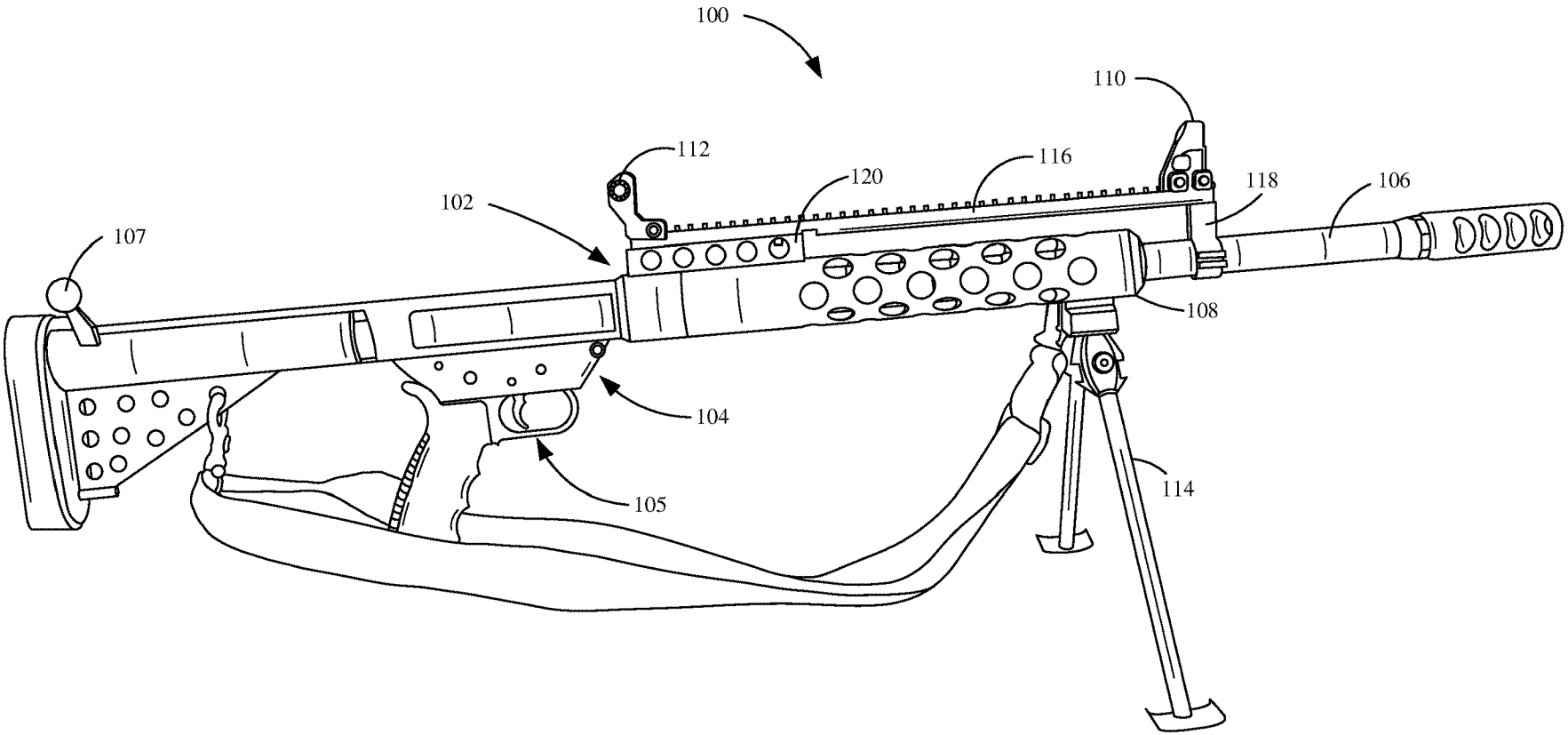
FIG. 1 is a perspective view showing an example weapon system.

FIG. 1 is a perspective view showing an example weapon system 100. Weapon system 100 includes a variety of different components as shown. Weapon system 100 includes an upper receiver 102 that couples to a lower receiver 104. To fire weapon system 100, a round is loaded into upper receiver 102 (near the interface of upper receiver 102 and lower receiver 104) and bolt 107 is driven forward to chamber the round into barrel 106. Once chambered, trigger 105 is actuated to engage the firing pin into contact with a primer on the round and the bullet is expelled from barrel 106. Of course, in other examples, the weapon system may operate in different ways as well, such as semi-automatic, automatic, magnetic driven bullets, etc.

As shown, the upper receiver includes barrel 106, handguard 108, front sight 110, rear sight 112, bipod 114, rail system 116, rail mount 118 and rail mount 120. Barrel 106 receives a round and expels a bullet (e.g., as shown a .50 BMG). Handguard or barrel shroud 108 protects a user's hand from the heat generated by barrel 106. Typically, a barrel shroud, such as barrel shroud 108, does not contact barrel 106 for two reasons. First heat would more easily transfer to barrel shroud 108 and second if barrel shroud 108 is used to support the weapon it would put torque on barrel 106 and decrease the accuracy of weapon system 100. In a similar vein, piston driven semi/automatic weapons, such as Avtomat Kalashnikov (AK) style weapons, use a piston driven by gas from their barrel 106 to cycle the weapon, which puts similar torque on barrel 106. As shown, rail system 116 is mounted to barrel 106 via rail mount 118. But because rail system 116 is mounted to barrel 106 from the top and there are no moving components on rail system 116 (such as a piston), this mounting actually stiffens barrel 106.

Rail system 116 allows the coupling of front sight 110 and rear sight 112 to weapon system 100. Alignment of front sight 110 and rear sight 112 allows a user to accurately aim weapon 110. The greater the distance between these two sights, typically, the more precise a user can be. Rail system 116 is coupled to weapon system 100 in the front by rail mount 118 and in the rear by rail mount 120. Rail mount 118 is coupled to the barrel 106 as explained above and rail mount 120 is coupled to, or permanently part of, upper receiver 102.

Figure 2:
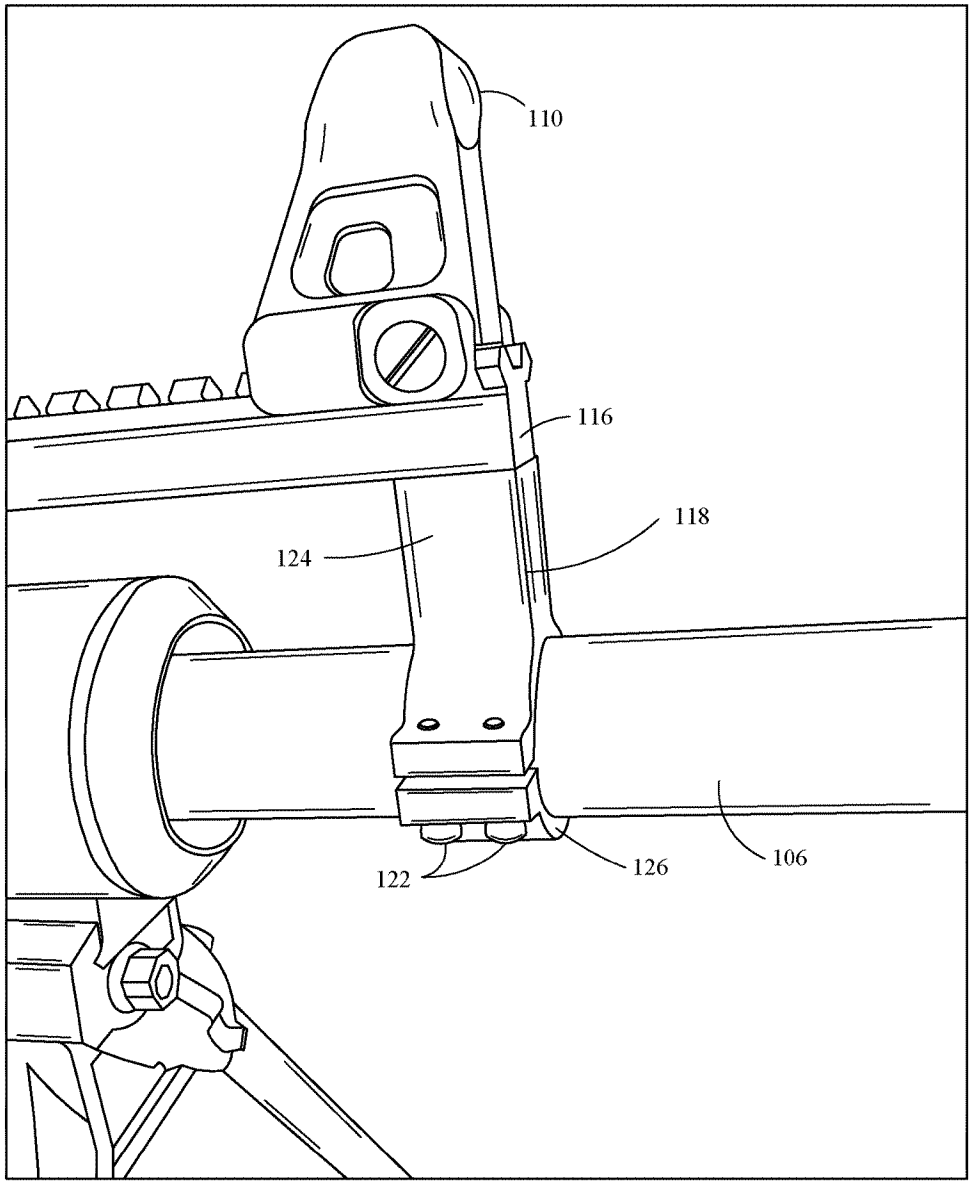
FIG. 2 is a perspective view showing a forward portion of an example rail system.

FIG. 2 is a perspective view showing a forward portion of an example rail system 100. As shown, rail mount 118 couples to barrel 106. To do this, rail mount 118 includes a top portion 124 and a bottom portion 126. The portions 124 and 126 are tightened onto barrel 106 by fasteners 122. For instance, fasteners 122 are hex head cap screws. In other examples, rail mount 118 is coupled to barrel 106 in other ways as well. Rail system 116, as shown, is coupled to rail mount 118 by a fastener.

Figure 3:
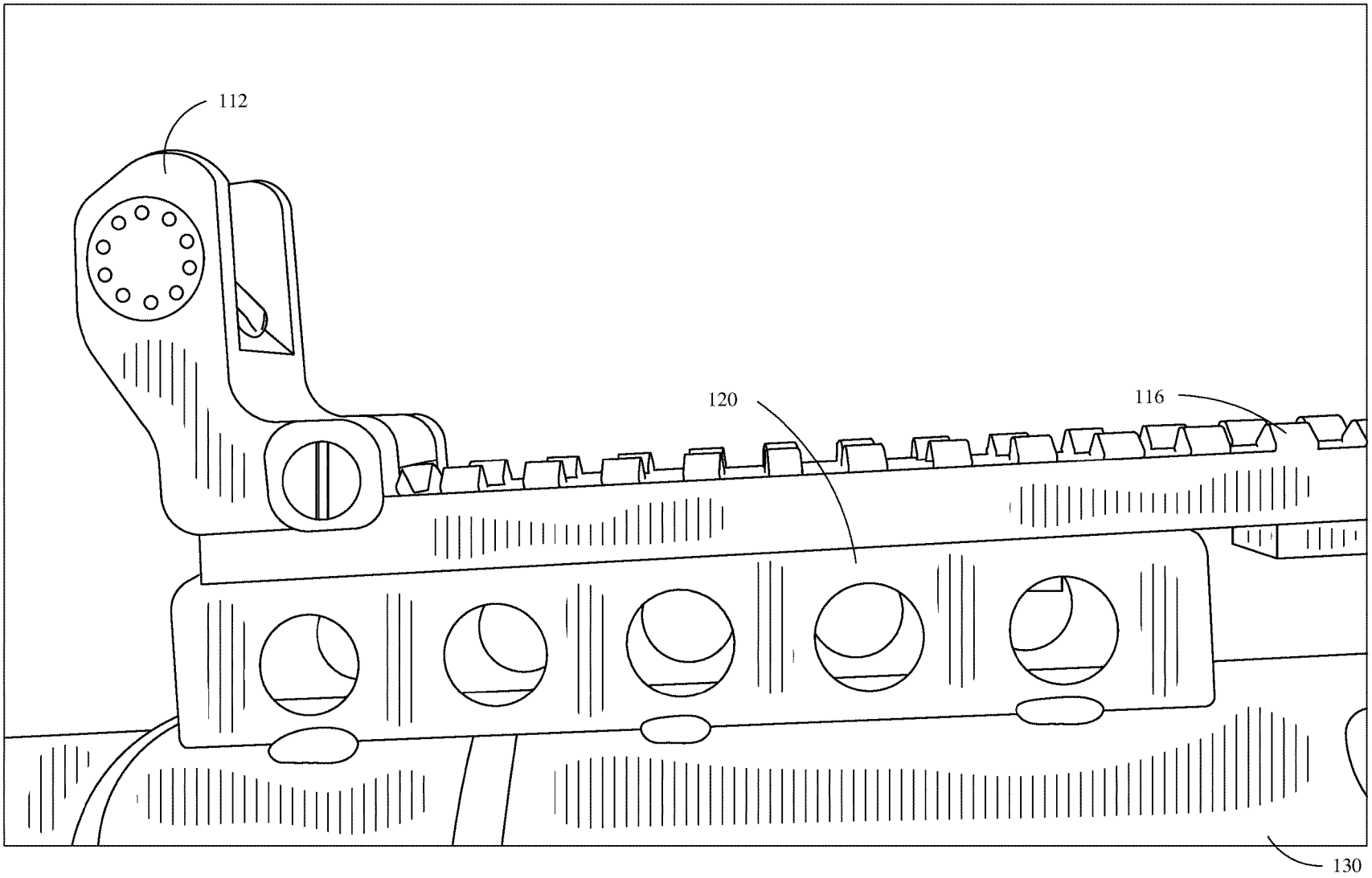
FIG. 3 is a perspective view showing a rearward portion of an example rail system.

FIG. 3 is a perspective view showing a rearward portion of an example rail system 100. As shown, rail mount 120 is welded to the upper receiver of the weapon system. Rail 116 is coupled to rail mount 120 by a set of fasteners shown in FIG. 4. A typical weapon system has a rail that is only as long as rail mount 120 (e.g., length 130 shown in FIG. 5). This limits the types of attachments that can be mounted to the weapon system. For instance, on a large caliber weapon system with a large recoil, it is beneficial to the user for the optic to be a distance away from their eye. Rail 116 allows the optic to be placed farther down the weapon and away from the user's eye.

Figure 4:
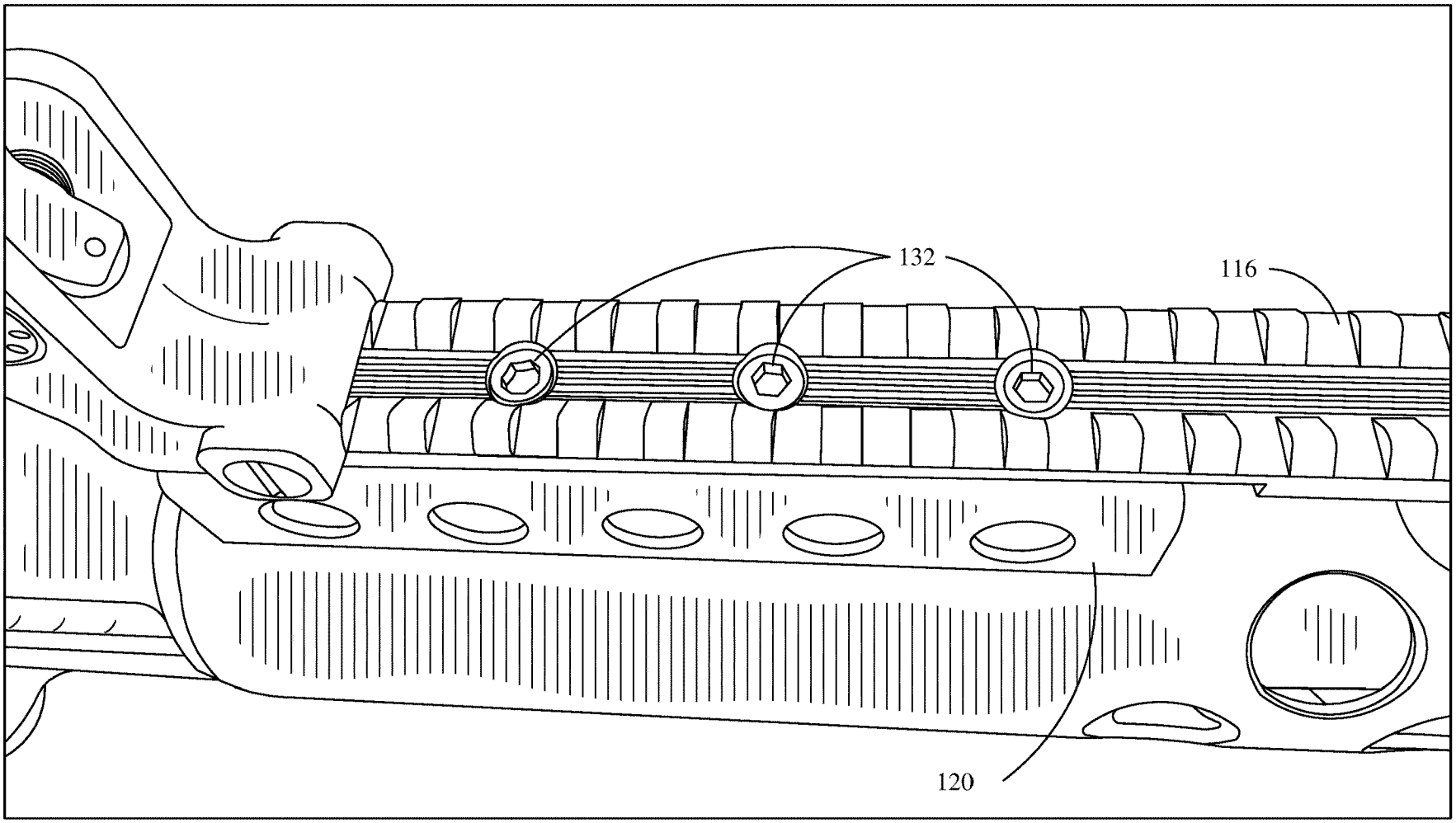
FIG. 4 is a top perspective view showing a rearward portion of an example rail system.

FIG. 4 is a top perspective view showing a rearward portion of an example rail system 106. As shown, rail system 116 is coupled to rail mount 120 by a set of fasteners 132. In other examples, rail system 116 can be coupled to the rail mount 120 using other means as well, such as welding, machined as part of the system, etc.

Figure 5:
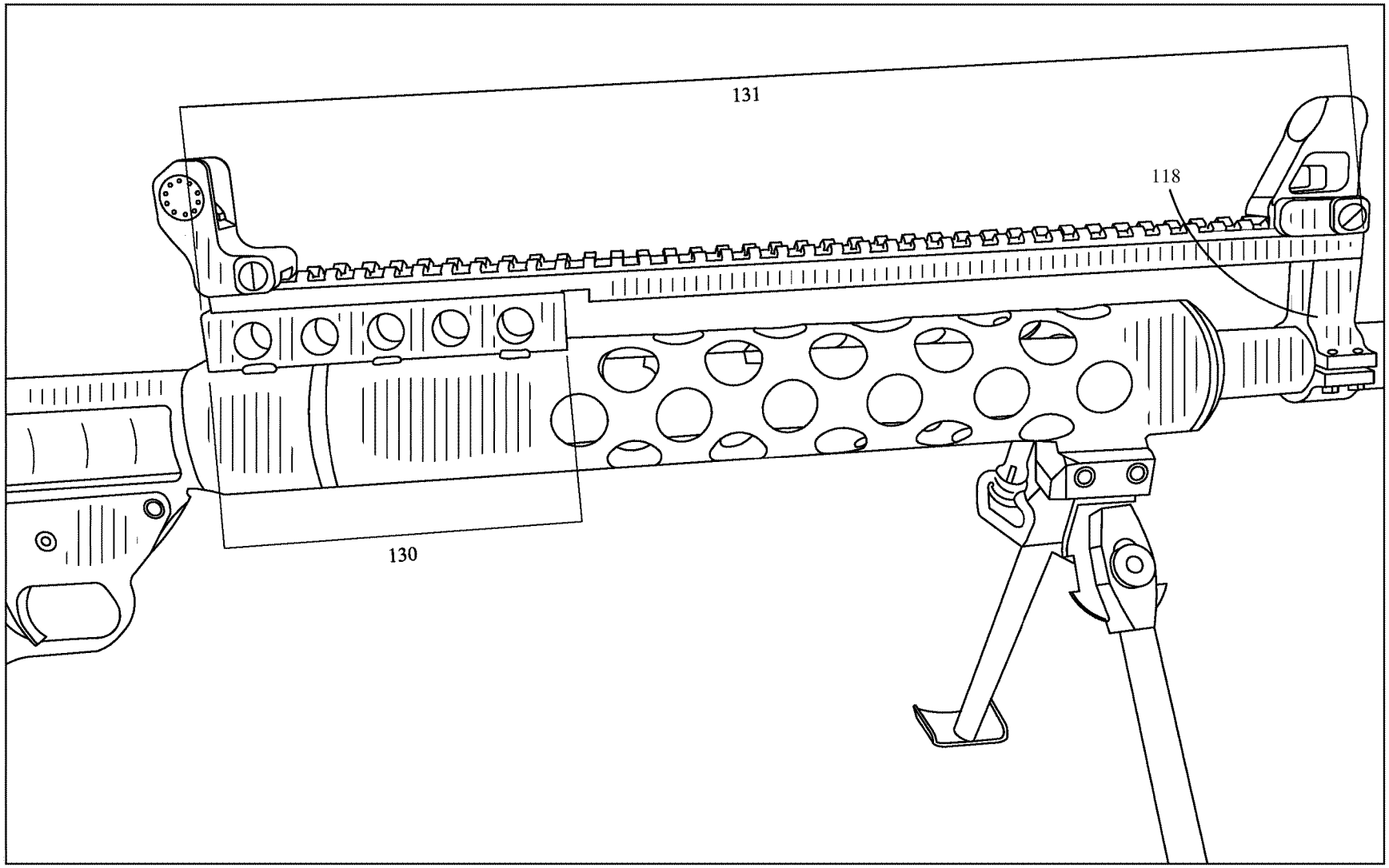
FIG. 5 is a side view showing an example rail system on a weapon system.

FIG. 5 is a side view showing an example rail system 100 on a weapon system. As shown, the "standard" optic mounting location has a short length 130. Rail system 116 extends an optic mounting location to a long length 131. This allows for longer optics, more accessories, and/or more optics/sights to be mounted on the weapon system. Rail system 116 can be twice or three times as long as the standard rail mount 120. It can vary by other lengths as well. In the example shown, rail system 116 extends forward of shroud 108 on weapon system 100, as well.

Although the present invention has been described with reference to preferred embodiments, workers skilled in the art will recognize that changes may be made in form and detail without departing from the spirit and scope of the invention.

What is claimed is:

1. An extended rail system for a weapon system, the extended rail system comprising:

a rearward mount configured to be in contact with a barrel shroud;

a forward mount configured to fit around a barrel of the weapon system, the forward mount comprising:

a top portion configured to fit over a top of the barrel, the top portion including:

a riser configured to extend upwards relative to the barrel, when the weapon system is upright, to a height less than a height of the rearward mount; and a bottom portion configured to fit over a bottom of the barrel and separable from the top portion; and a rail configured to couple to the forward mount at a first end of the rail and coupled to a rearward mount at the second end of the rail, the rail further configured to span a full length of the barrel shroud and be out of contact with the barrel shroud.

2. The extended rail system of claim 1, wherein the rail comprises a picatinny rail.

3. The extended rail system of claim 2, wherein a length of the rail is greater than ⅓ of a length of the weapon system.

4. The extended rail system of claim 2, wherein a length of the rail is in the range of 16 inches to 20 inches.

5. The extended rail system of claim 1, wherein the top portion and the bottom portion are configured to receive fastening mechanisms to couple the top portion to the bottom portion.

6. The extended rail system of claim 1, wherein the weapon system comprises a Serbu BFG-50.

7. A rail system for a weapon system, the rail system comprising:

a rearward mount;

a rail having a plurality of fastener apertures;

a first plurality of fasteners that couple the rail to the rearward mount of the weapon system;

a front mount having a first portion configured to fit around a first portion of a barrel of the weapon system and second portion configured to fit around a second potion of the barrel of the weapon system, the first portion of the front mount and the second portion of the front mount are configured to separate, wherein the first portion of the front mount includes a riser configured to extend upwards relative to the barrel, when the weapon system is upright, to a height less than a height of the rearward mount;

a second plurality of fasteners that couple the rail to the front mount; and wherein the first and second plurality of fasteners are received by the plurality of fastener apertures.

8. The rail system of claim 6 wherein the rail is a picatinny rail.

9. The rail system of claim 6 wherein the front mount couples to a barrel of the weapon system.

10. A weapon system comprising:

a receiver;

a barrel coupled to the receiver;

a barrel shroud in contact with to the receiver and extending over a portion of the barrel;

a rearward rail mount in contact with to the barrel shroud and spanning a portion of the length of the barrel shroud; and a rail system comprising:

a forward rail mount coupled to the barrel forward of the barrel shroud, the forward rail mount comprising:

a top portion fit around and in contact with a top side of the barrel, the top portion including:

a riser that extends upwards, relative to the barrel when the weapon system is upright, to a height less than a height of the rearward rail mount; and a plurality of fastener receiving portions; and a bottom portion fit around and in contact with a bottom of the barrel, the bottom portion including a plurality of fastener receiving portions; and wherein the bottom portion and top portion are separable and coupled to one another by a plurality of fasteners that extend first through the plurality of fastener receiving portions of the bottom portion and are received by the plurality of fastener receiving portions of the top portion, coupling the bottom portion to the top portion around the barrel; and a rail, coupled to the rearward mount at a rearward end of the rail and extending over the barrel shroud and coupled to the riser of the first portion of the forward rail mount at a forward end of the rail, the rail out of contact with the barrel shroud.

* * * * *